US007097194B2

(12) United States Patent
Kogler

(10) Patent No.: US 7,097,194 B2
(45) Date of Patent: Aug. 29, 2006

(54) SKI BINDING, IN PARTICULAR FOR CROSS-COUNTRY SKIING

(75) Inventor: Hannes Kogler, Vöcklabruck (AT)

(73) Assignee: Fischer Gesellschaft mbH, Ried im Innkreis (AT)

( * ) Notice: Subject to any disclaimer, the term of this patent is extended or adjusted under 35 U.S.C. 154(b) by 138 days.

(21) Appl. No.: 10/510,440

(22) PCT Filed: Apr. 4, 2003

(86) PCT No.: PCT/AT03/00100

§ 371 (c)(1),
(2), (4) Date: Oct. 7, 2004

(87) PCT Pub. No.: WO03/084620

PCT Pub. Date: Oct. 16, 2003

(65) Prior Publication Data

US 2005/0167949 A1 Aug. 4, 2005

(30) Foreign Application Priority Data

Apr. 11, 2002 (AT) ..... A 560/2002

(51) Int. Cl.
*A63C 9/20* (2006.01)

(52) U.S. Cl. ..... 280/615; 280/625; 280/14.2; 280/617; 280/607; 280/624

(58) Field of Classification Search ..... 280/609, 280/618

See application file for complete search history.

(56) References Cited

U.S. PATENT DOCUMENTS

| | | | | |
|---|---|---|---|---|
| 5,697,631 | A * | 12/1997 | Ratzek et al. | 280/613 |
| 6,209,904 | B1 | 4/2001 | Schnitzhofer | |
| 6,390,494 | B1 * | 5/2002 | Gignoux et al. | 280/615 |
| 2004/0140647 | A1 | 7/2004 | Kogler | |

FOREIGN PATENT DOCUMENTS

| | | |
|---|---|---|
| DE | 27 06 111 A1 | 8/1978 |
| DE | 31 41 425 C1 | 11/1982 |
| DE | 32 27 237 C1 | 1/1984 |
| WO | WO 84/00498 | 2/1984 |
| WO | WO 97/34667 | 9/1997 |
| WO | WO 02/087710 A1 | 11/2002 |

* cited by examiner

*Primary Examiner*—Christopher P. Ellis
*Assistant Examiner*—Cynrhia F. Collado
(74) *Attorney, Agent, or Firm*—Jacobson Holman PLLC

(57) ABSTRACT

A ski binding, in particular for cross-country skiing, having a sliding element displaceable in the running direction, as well as at least two spring-loaded latching pins movable transversely to the running direction for latching engagement in corresponding fittings in the tip region of the ski boot. Each of the two latching pins is carried by a spring-loaded molded part, the molded parts being oppositely arranged relative to one another and guided in links of the sliding element.

20 Claims, 8 Drawing Sheets

SKI BINDING, IN PARTICULAR FOR CROSS-COUNTRY SKIING

This is a nationalization of PCT/AT03/00100 filed Apr. 4, 2003 and published in German.

BACKGROUND OF THE INVENTION

1. Field of the Invention

The present invention relates to a cross-country ski binding having a step-in mechanism.

2. Description of the Related Art

From DE 27 06 111 A, a ski binding of the initially mentioned type is known, in which two transversely movable, spring-loaded pins are provided which are carried by a spring steel wire, which consists of two levers each rotatably held on a rotation axis fixed on a carrier and directed perpendicularly to the ski upper side, which levers comprise pins acting like tongs for a respective engagement in a bearing arranged at the side of the toe-cap. This binding harbors the risk of an unintentional opening of the binding when travelling over uneven ground.

SUMMARY OF THE INVENTION

It is an object of the present invention to provide measures for counteracting the above-mentioned deficiency of the known ski binding and, moreover, to allow for a simple construction which is easy to mount.

This object is achieved by the a ski binding according to the present invention, in particular for cross-country skiing, that includes a sliding element displaceable in the running direction, as well as at least two spring-loaded pins movable in transverse direction for latching engagement in corresponding fittings in the tip region of the ski boot (step-in mechanism). Each of the two latching pins is carried by a molded part that is movable transversely to the running direction. Each molded part is loaded by a spring acting transversely to the running direction and is guided in one link each of the sliding element, the sliding element being displaceable in the running direction.

The sliding element may be guided in the running direction on a base plate fastened to the ski, the base plate being covered at least in the region of the tip of the ski boot by a housing in which openings are provided on either side thereof so as to receive the latching pins of the step-in mechanism. By thus dividing the control mechanism, a higher resilience is achieved and, thus, pressing out of amounts of snow possibly present in openings of the boot fittings is achieved.

According to one construction, the sliding element, via a hinge extending transversely to the running direction, is connected to a lever that projects obliquely upwards in the running direction, having an oblique surface destined for stepping out, and a depression for insertion of the pole for opening the binding. By this mode of construction, a particularly economical production is possible, on the one hand, while it is ensured, on the other hand that the opening mechanism will also remain functional under difficult environmental conditions (icing up).

The base plate may be provided with a peripheral rib which engages in a corresponding groove of the housing part. In this way, the binding mechanism is protected against the penetration of water and snow.

According to one preferred embodiment, the latching pins project on both sides of the binding from one molded part each. The molded Parts are located in mirror-inverted relationship on either side of the binding and are provided with a projection extending into a link of the sliding element.

The link may consist of preferably triangular openings located symmetrically opposite each other about an axis extending transversely to the running direction. Each of these openings is provided with a respective guiding face on which the respective projection of the molded part is supported. By the triangular opening, linear guiding of the projections of the molded part is achieved, and thus, a precise control with as little frictional resistance as possible is attained.

The molded parts are each provided with a tapped blind hole for receiving a pressure spring which is tensioned between oppositely arranged molded parts, allowing for a particularly simple mode of construction, in particular for mounting.

Viewed in the running direction, at least two pressure springs are adjacently arranged. In this way, an increased resilience is obtained, thereby making it easier for the projections of the molded parts to press out any possible accumulations of snow in the corresponding openings of the boot parts.

Oppositely arranged projections of the molded parts are supported on oblique guiding faces in the openings of the sliding element. These openings, which serve as links, are, by displacement of the sliding element, movable towards or away from each other, respectively, and are under the action of the springs. According to this arrangement, the safety of the binding is increased.

According to a further embodiment, the ski-tip side end of the sliding element or the end thereof facing away from the lever is guided in a bridge part of the housing. By this bridge-like configuration, the economical mode of production can be combined with an exact linear guiding.

In the drawings, an exemplary embodiment of the cross-country ski binding according to the invention is explained in more detail.

DETAILED DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

The binding housing consists of an external housing part 100 which has openings 103 on both sides for receiving the pins 101 of the step-in mechanism.

Figure 2:
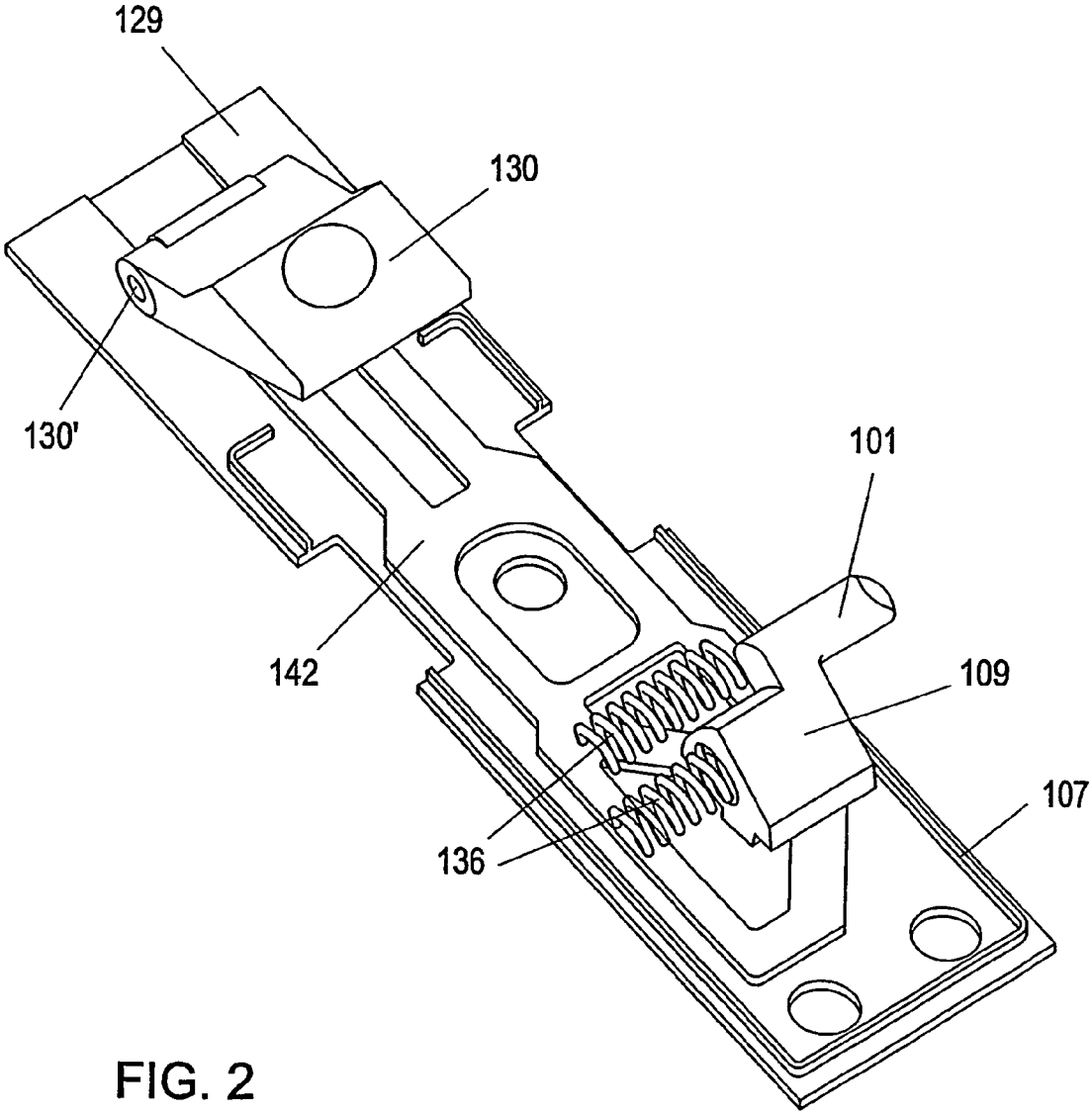
FIG. 2 shows a lid with the sliding element of the opening mechanism.
Figure 3:
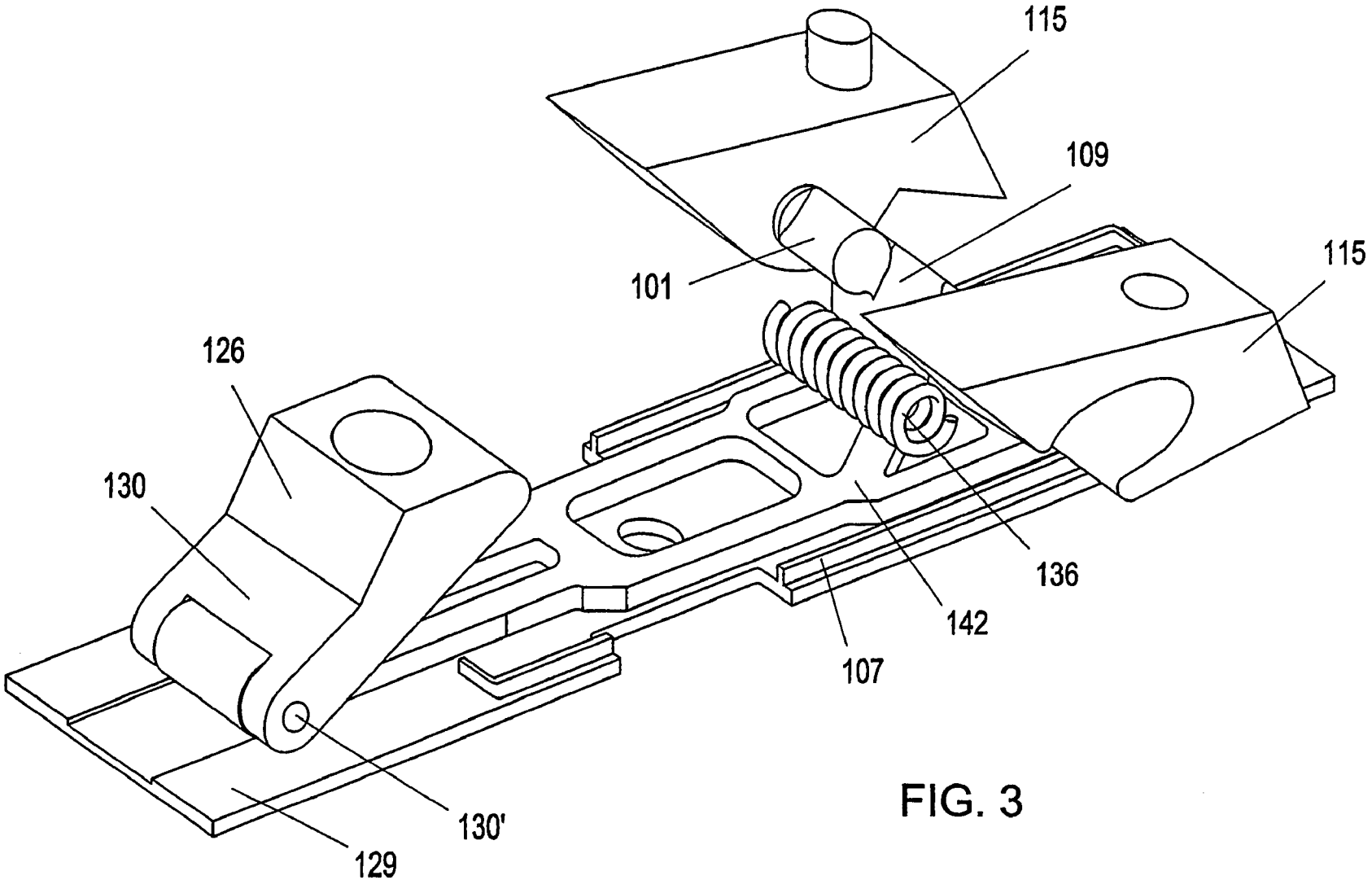
FIG. 3 shows the opening mechanism.
Figure 5:
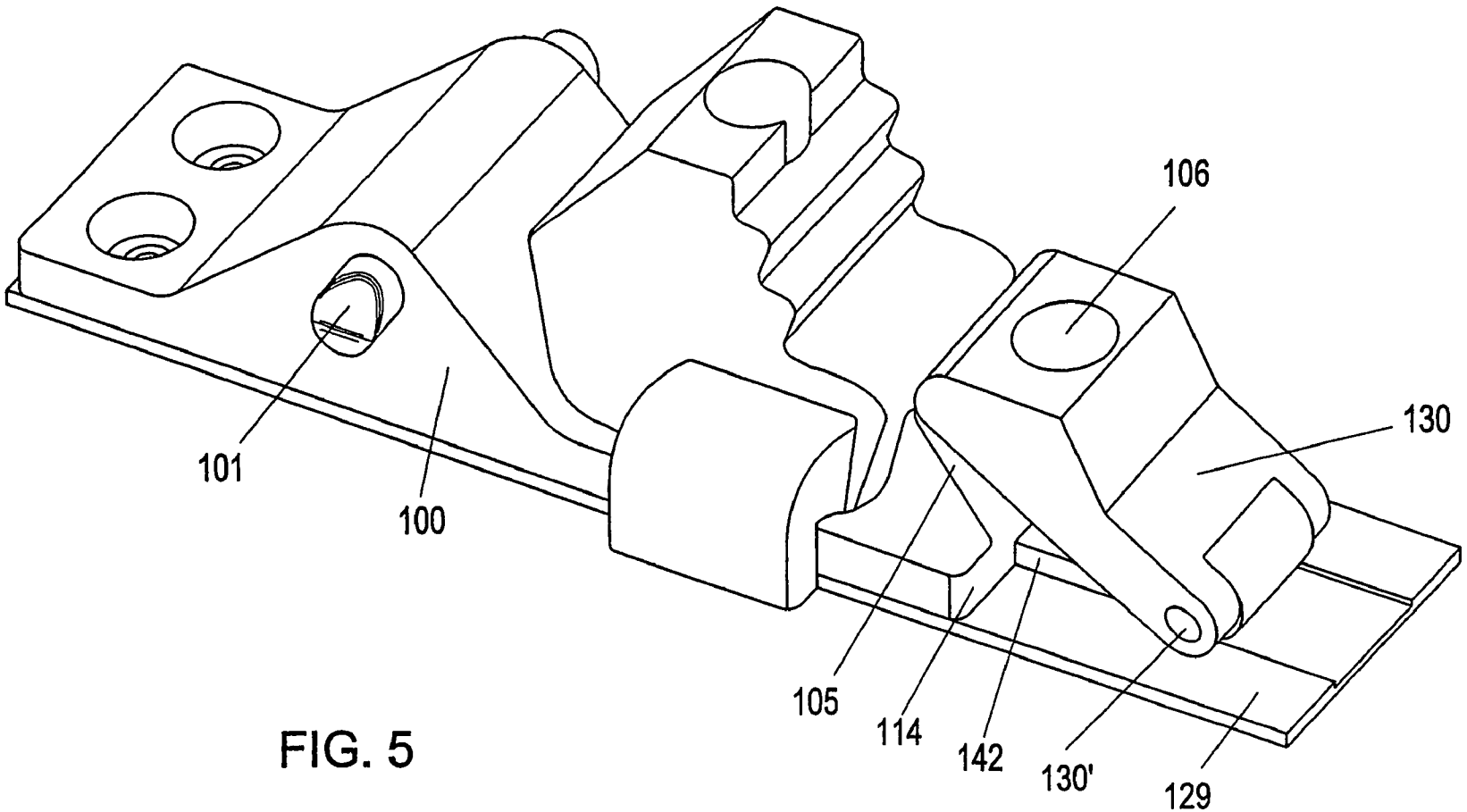
FIG. 5 shows a detail of the binding.

The housing 100 of the cross-country ski binding is seated on a base plate 120 which, e.g., is screwed to a ski, on which base plate a sliding element 142 is mounted so as to be displaceable in the running direction, as shown in FIGS. 2 and 3, which sliding element, via a hinge 130' extending transversely to the running direction, is connected to a lever 130 that projects obliquely upwards in the running direction, said lever, as is visible in FIG. 5, having an oblique surface 105 destined for stepping out, and a depression 106 for insertion of the pole for opening the binding.

Figure 1:
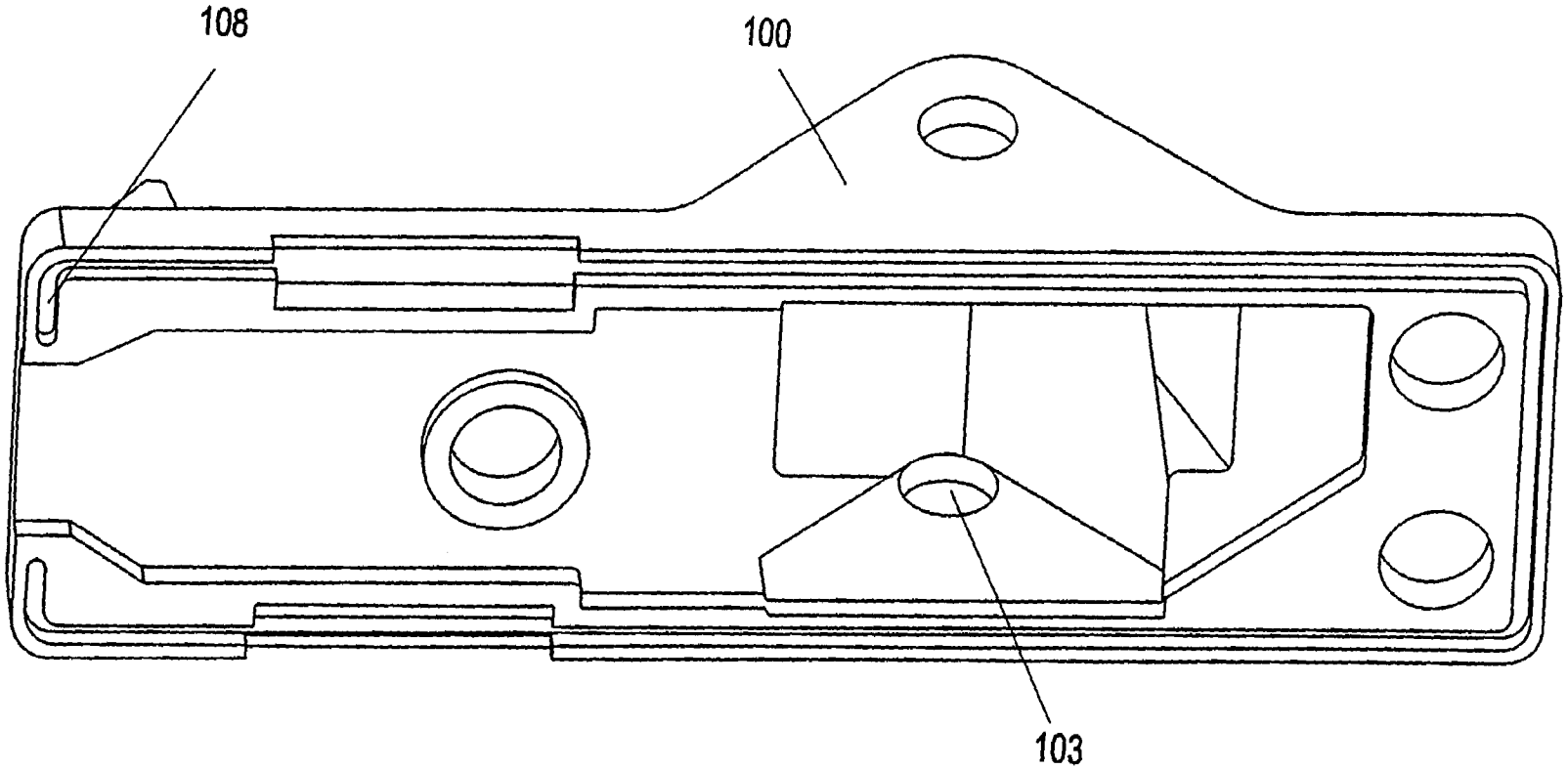
FIG. 1 shows a bottom view of the housing of the ski binding.

To prevent snow from penetrating between base plate 129 and binding housing 100, the former is provided with a peripheral rib 107 which engages in a corresponding groove 108 of the housing part 100 (FIGS. 1 and 3).

For the inventive cross-country ski binding to function as a step-in binding, either the pin projections 101 may be chamfered or rounded towards the top, or vice versa, if the pins are not chamfered, the corresponding boot fittings may have appropriate guiding curves so that stepping into the binding is possible without actuating the lever 130.

Figure 4:
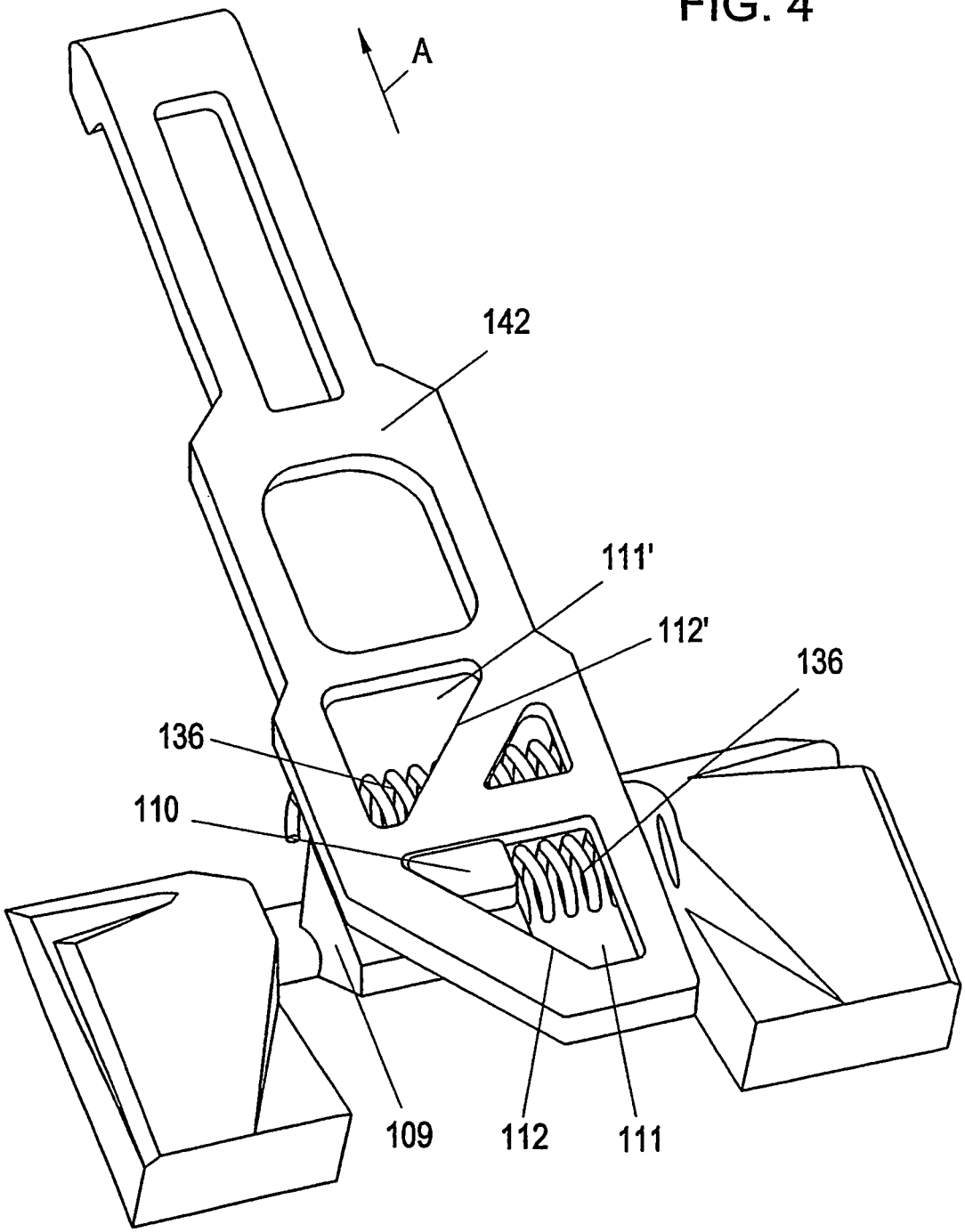
FIG. 4 shows a detail of the opening mechanism.

On both sides of the binding, the pins 101 project from one molded part 109 each (FIGS. 1, 2 and 3), which molded parts are located in mirror-inverted relationship on either side of the binding and provided with a projection 110 which, as shown in FIG. 4, extends into a triangular opening 111 or 111', respectively, of the sliding element 142. As can be seen in FIG. 4, the openings 111, 111' are located symmetrically opposite each other about an axis extending transversely to the running direction, and they are each provided with a guiding face 112, or 112', respectively, on which the respective projection 110 of the molded part 109 is supported, only one of the two projections 110 being entered in FIG. 4 for the sake of clarity.

In the present case, the latching pins 101 are each provided with a rounded portion at their ends facing away from each other, which rounded portion is located above that plane which extends through the longitudinal axis of the pin and, in the engaged state, in parallel to the ski upper side. The rounded portion may, however, extend as far as to the lower generatrix of the latching pins.

Figure 6:
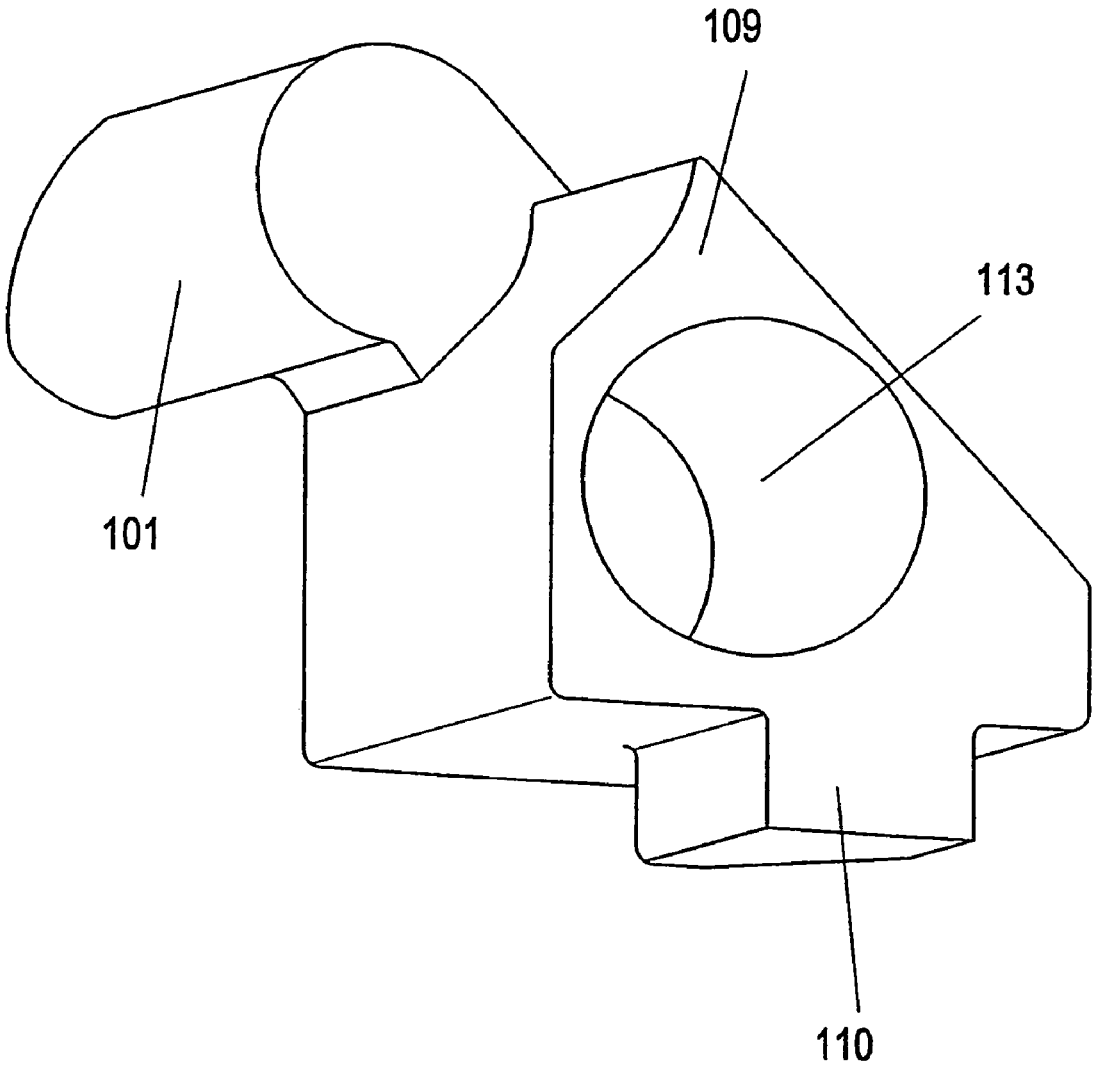
FIG. 6 shows a further detail of the binding.
Figure 7:
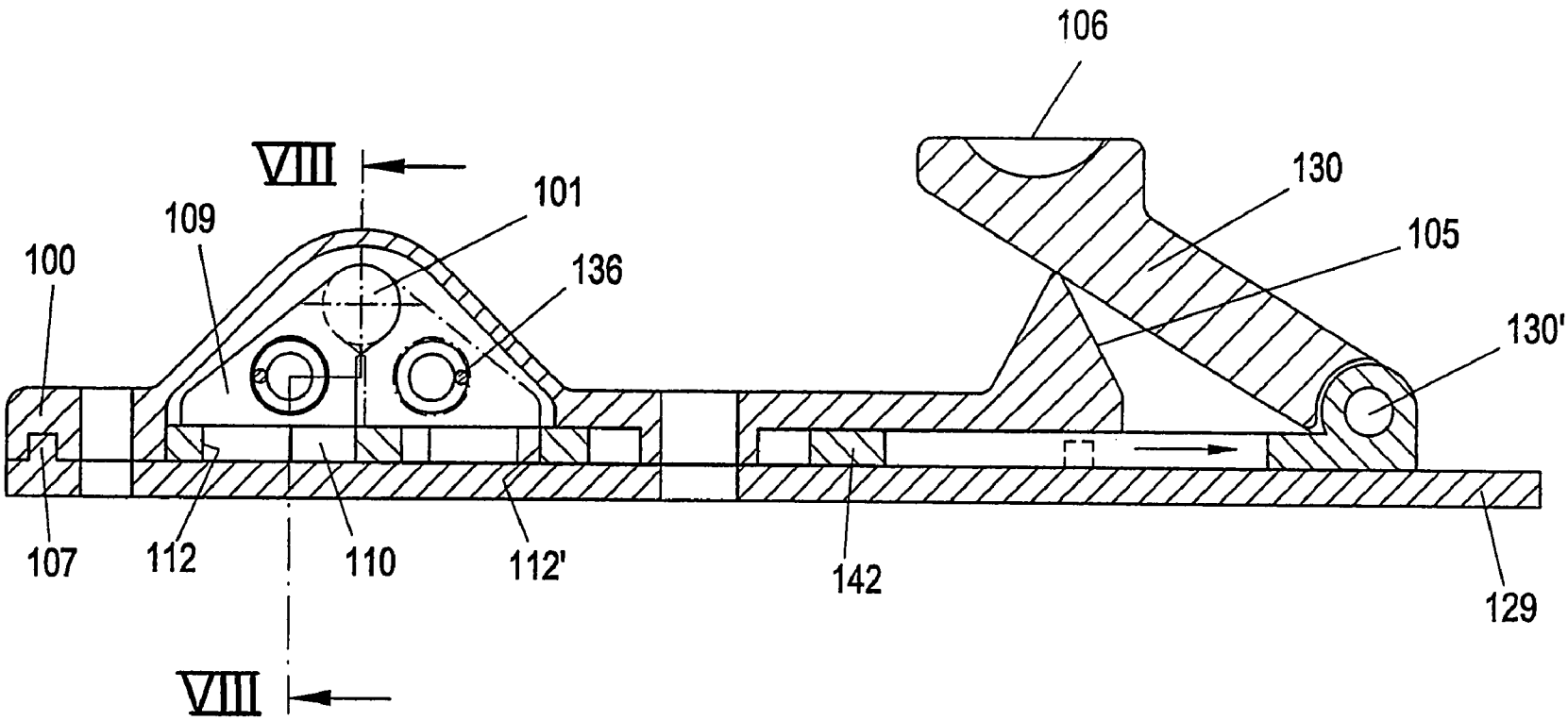
FIG. 7 shows a central longitudinal section of the binding part according to FIG. 2.
Figure 8:
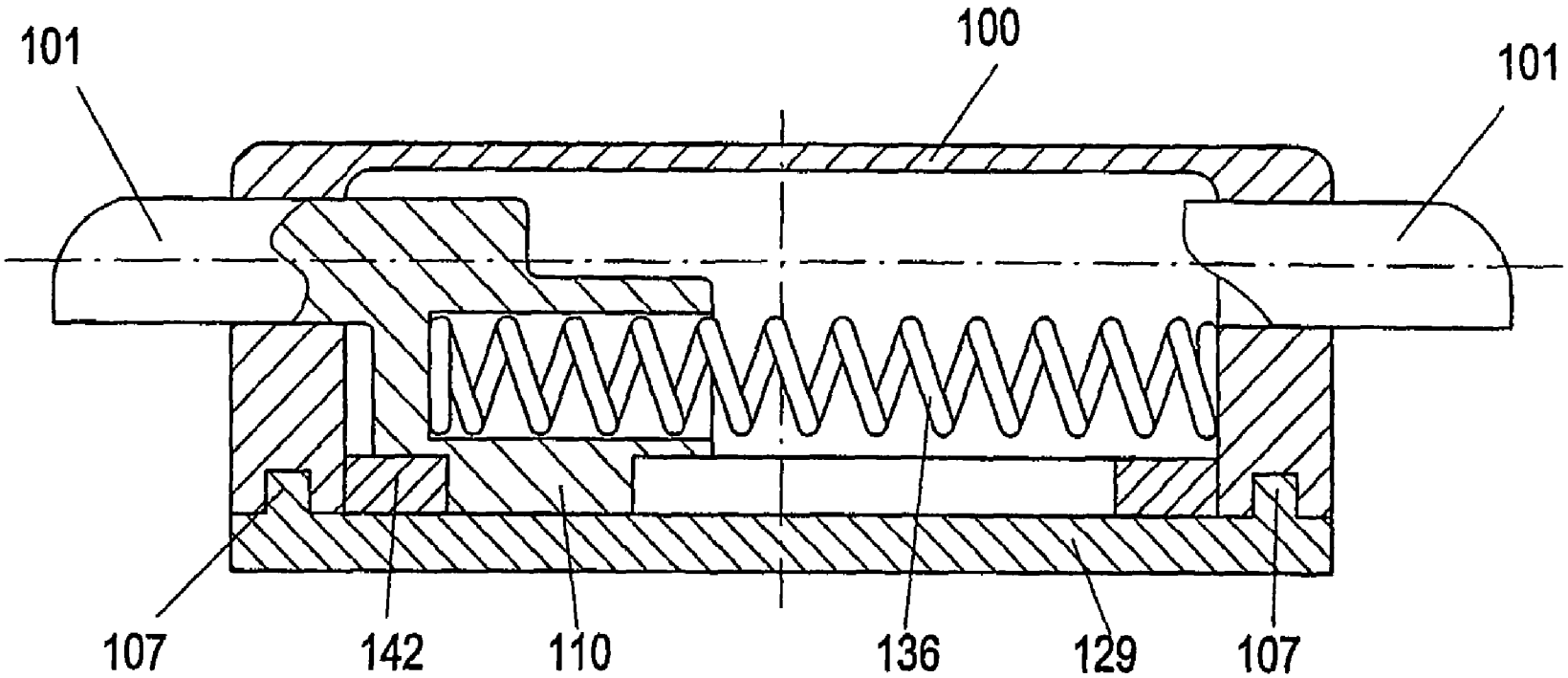
FIG. 8 shows a section according to line VIII—VIII of FIG. 7.

The molded parts 109 are each provided with a tapped blind hole 113 for receiving a pressure spring 136 (FIGS. 3 and 6) which is tensioned between the molded parts 109 and the housing wall of the binding housing 100. As can be seen from FIG. 4, preferably two pressure springs 136 are provided which are located adjacent each other in running direction.

The mirror-inverted arrangement of the two molded parts 109 and the possibility of installing two adjacently arranged pressure springs 136 provide for a substantially higher resilience than exists in conventional cross-country ski bindings, making it possible to better press out snow accumulated in corresponding holes of the boot.

The diagonally oppositely arranged projections 110 are supported on the oblique guiding faces 112, 112' in the acute-angled corners of the openings 111, 111' of the sliding element 142. When displacing the sliding element, the projections 110 are pressed towards each other under the influence of the guiding faces 112 and 112' contrary to the force of the springs 136, so as to release the pins 101 from their engaged position.

For stepping out, the skier presses the lever 130 downwards in the depression 106 with his pole. By this, the lever 130 slides along the chamfered face 105 obliquely forwards and downwards, thereby pulling the sliding element 142 forwards, whereby the two molded parts 109 are pulled together along the control curves 112, 112' and thus, the latching pins 101 release the boot.

On its front end facing away from the lever 130, the sliding element 142 is guided in the bridge part 114 of the housing 100 visible in FIG. 5.

In FIG. 3, the boot fittings are schematically indicated and denoted by 115.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

What is claimed is:

1. A ski binding for a cross country ski boot, comprising a sliding element displaceable in a running direction when skiing, at least two spring-loaded latching pins facing away from one another and engaging in corresponding fittings in a tip region of the ski boot, said latching pins being respectively carried by a pair of molded parts located in mirror-inverted relationship on either side of the binding, each molded part being loaded by a spring acting to move said molded part and respective latching pin transversely to the running direction and having an element guided in a link of the sliding element.

2. The ski binding according to claim 1, wherein the sliding element is guided in the running direction on a base plate fastened to the ski, the base plate being covered at least in a region of the tip of the ski boot by a housing in which openings are provided on either side thereof so as to receive the latching pins.

3. The ski binding according to claim 1, wherein the sliding element, via a hinge extending transversely to the running direction, is connected to a lever that projects obliquely upwards in the running direction, and has an oblique surface for stepping out of said binding, and a depression for insertion of a ski pole for opening the binding.

4. The ski binding according to claim 2, wherein the base plate is provided with a peripheral rib which engages in a corresponding groove of the housing.

5. The ski binding according to claim 1, wherein said movable part element guided in the link includes a projection extending into said link on the sliding element.

6. The ski binding according to claim 5, wherein the link includes triangular openings located symmetrically opposite each other about an axis extending transversely to the running direction, each of said openings being provided with a guiding face on which the respective projection of the molded part is supported.

7. The ski binding according to claim 1, wherein the molded parts are each provided with a tapped blind hole for receiving the spring which is tensioned between the oppositely arranged molded parts.

8. The ski binding according to claim 1, wherein at least two pressure springs are adjacently arranged.

9. The ski binding according to claim 1, wherein the links of the sliding element include openings and said projections of the molded parts are supported on oblique guiding faces in said openings and, by displacement of the sliding element, are movable towards or away from each other, respectively, and are under the action of the spring.

10. The ski binding according to claim 2, wherein a ski-tip side end of the sliding element is guided in a bridge part of the housing.

11. The ski binding according to claim 1, wherein each of said pins has a rounded portion at an outer end thereof, said rounded portion being located above a plane that extends through a longitudinal axis of said pins.

12. A ski binding for cross-country skiing, comprising a sliding element displaceable in a running direction when skiing, at least two spring-loaded latching pins for latching engagement in corresponding fittings in a tip region of a ski boot, each of the two latching pins being carried by a respective molded part, said molded parts being oppositely arranged relative to one another with each molded part having a tapped blind hole for receiving a pressure spring which is tensioned between said oppositely arranged molded parts and which acts to move said molded parts and latching pins transversely to the running direction, each of said molded parts being seated in said sliding element.

13. The ski binding according to claim 12, wherein each molded part has a projection that extends into an opening in the sliding element, said projections being supported on oblique guiding faces within the openings such that, by displacement of the sliding element, said projections are movable toward or away from each other, respectively, under action of the pressure spring.

14. A ski binding for cross-country skiing, comprising a sliding element displaceable in a running direction when skiing, at least two latching pins for latching engagement in corresponding fittings in a tip region of a ski boot, each of the two latching pins being carried by a respective molded part that is loaded by a respective pressure spring so as to be movable transversely to the running direction, said pressure springs being adjacently arranged, and each of said movable parts being guided in a respective link of the sliding element.

15. The ski binding according to claim 14, wherein the latching pins face away from one another, with the respective molded parts being located in mirror-inverted relationship on either side of the binding.

16. The ski binding according to claim 14, wherein each molded part has a projection that extends into the respective link of the sliding element.

17. The ski binding according to claim 14, wherein said links include openings in the sliding element, each of said movable parts having a projection that extends into a respective opening and is supported on an oblique guiding face therein such that, by displacement of the sliding element, said projections are movable towards or away from each other, respectively, under action of the spring.

18. A ski binding for cross-country skiing, comprising a sliding element displaceable in a running direction when skiing, at least two spring-loaded latching pins for latching engagement in corresponding fittings in a tip region of a ski boot, each of the two latching pins being carried by a respective molded part that is loaded by a spring so as to be movable transversely to the running direction, each of said movable parts having a projection that extends into a respective opening in the sliding element, said projections being supported on oblique guiding faces in the openings and, by displacement of the sliding element, being movable towards or away from each other, respectively, under action of the spring.

19. The ski binding according to claim 18, wherein the molded parts are oppositely arranged on either side of the binding.

20. The ski binding according to claim 18, wherein each of said pins has a rounded portion at an outer end thereof, said rounded portion being located above a plane that extends through a longitudinal axis of said pins.

* * * * *